US007259733B2

(12) United States Patent
Jin

(10) Patent No.: US 7,259,733 B2
(45) **Date of Patent: *Aug. 21, 2007**

(54) APPARATUS AND METHOD FOR DRIVING PLASMA DISPLAY PANEL

(75) Inventor: Kwang-Ho Jin, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 84 days.

This patent is subject to a terminal disclaimer.

(21) Appl. No.: 11/075,870

(22) Filed: Mar. 10, 2005

(65) Prior Publication Data

US 2005/0162347 A1 Jul. 28, 2005

Related U.S. Application Data

(63) Continuation of application No. 10/265,571, filed on Oct. 8, 2002, now Pat. No. 6,900,783.

(30) Foreign Application Priority Data

Oct. 15, 2001 (KR) ..... 2001-63453

(51) Int. Cl.
*G09G 3/28* (2006.01)

(52) U.S. Cl. ..... 345/60; 345/211

(58) Field of Classification Search ..... 345/60–69, 345/76, 211, 204–206; 315/169.4
See application file for complete search history.

(56) References Cited

U.S. PATENT DOCUMENTS

| | | | | |
|---|---|---|---|---|
| 5,517,207 | A | 5/1996 | Kawada et al. | 345/78 |
| 6,011,355 | A | 1/2000 | Nagai | 315/169.3 |
| 6,121,943 | A | 9/2000 | Nishioka et al. | 345/76 |
| 6,278,243 | B1 | 8/2001 | Yoo | 315/169.4 |
| 6,567,059 | B1 | 5/2003 | Ide et al. | 345/60 |
| 2001/0026254 | A1 | 10/2001 | Ide et al. | 345/60 |
| 2002/0196210 | A1 | 12/2002 | Moon | 345/75.2 |

FOREIGN PATENT DOCUMENTS

| | | |
|---|---|---|
| KR | 1998-059332 | 8/1999 |

*Primary Examiner*—Regina Liang
(74) *Attorney, Agent, or Firm*—H.C. Park & Associates, PLC

(57) ABSTRACT

An apparatus for driving a plasma display panel PDP that prevents a scan driving circuit from being damaged includes a plurality of address electrodes and scan electrodes and sustain electrodes arranged in a zig-zag pattern so as to make pairs with each other. The apparatus includes an address driving circuit, for applying an address signal for selecting a discharge cell to the address electrodes, and a sustain driving circuit and a scan driving circuit for alternately applying a sustain-discharge voltage to the scan electrodes and to the sustain electrodes, to thus sustain-discharge the selected discharge cell. The scan driving circuit includes a protecting circuit for uniformly sustaining an electric potential difference between both ends of the scan driving circuit so that the electric potential difference is no more than a rated voltage of the scan driving circuit.

13 Claims, 3 Drawing Sheets

APPARATUS AND METHOD FOR DRIVING PLASMA DISPLAY PANEL

CROSS REFERENCE TO RELATED APPLICATION

This application is a continuation of prior U.S. patent application Ser. No. 10/265,571, filed on Oct. 8, 2002, now U.S. Pat. No. 6,900,783 which claims the benefit of Korean Application No. 2001-0063453, filed on Oct. 15, 2001, both of which are hereby incorporated by reference for all purposes as if fully set forth herein.

BACKGROUND OF THE INVENTION

1. Field of the Invention

The present invention relates to a circuit for driving a plasma display panel (PDP). More specifically, the present invention relates to a circuit for driving a PDP that is capable of preventing a scan driving integrated circuit (IC) from being damaged.

2. Description of the Related Art

In general, a PDP is a next generation flat plate display for displaying characters or images using plasma generated by gas discharge. Pixels ranging from hundreds of thousands to more than millions are arranged in the form of a matrix according to the size of the PDP.

PDPs are divided into direct current (DC) PDPs and alternating current (AC) is PDPs according to the shape of the waveform of an applied driving voltage and the structure of a discharge cell. Current directly flows in discharge spaces while a voltage is applied in the DC PDP, because electrodes are exposed to the discharge spaces. Therefore, a resistor for restricting the current must be used outside of the DC PDP. On the other hand, in the case of the AC PDP, the current is restricted due to the natural formation of capacity because a dielectric layer covers the electrodes. The AC PDP has a longer life than the DC PDP because the electrodes are protected against the shock caused by ions during discharge.

A memory characteristic that is one of the important characteristics of the AC PDP is caused by the capacity due to the dielectric layer that covers the electrodes.

According to the light emission principle of the AC PDP, discharge occurs because an electric potential difference in the form of a pulse is formed in scan electrodes and sustain electrodes. At this time, vacuum ultraviolet (UV) rays generated in a discharge process are excited to red (R), green (G), and blue (B) fluorescent bodies. The respective fluorescent bodies emit light due to light combination.

The discharge is affected by various parameters such as the kind and the pressure of the discharge gas inside the PDP, the secondary electron emission characteristic of an MgO protecting film, and the structures and the driving conditions of the electrodes.

An address and display separate (DS) driving method of the PDP includes a reset period, an address period, and a sustain period. In the reset period, the charge state of each cell is initialized so that an addressing operation can be smoothly performed on the cell. In the address period, cells that are turned on and cells that are not turned on are selected among the cells initialized by a reset operation, address discharge occurs only in the cells that are turned on, and wall charge is accumulated in the sustain electrodes.

In the sustain period, sustain discharge is performed by the sum of a voltage caused by the wall charge accumulated in the address period and a sustain discharge pulse alternately applied to both the scan electrodes and the sustain electrodes in order to actually display a picture on addressed cells.

An apparatus for driving a common PDP includes a controller, an address driving IC, a scan driving IC, and a sustain driving IC.

FIG. 1 is a block diagram showing a structure of the scan driving IC of the common PDP in accordance with the prior art.

As shown in FIG. 1, the scan driving IC 10 includes two field-effect transistors and a plurality of circuits having outputs positioned between the two field-effect transistors. Therefore, the scan driving IC 10 has a plurality of multiple outputs $Y_1$, $Y_2$, $Y_3$, . . . $Y_{n-1}$, and $Y_n$. The multiple outputs are respectively connected to the panel capacitance $C_p$, that is, $C_{p1}$, $C_{p2}$, $C_{p3}$, . . . $C_{pn-1}$, and $C_{pn}$.

The AC PDP has a capacitive panel load. The panel capacitance $C_p$ precedes charge and discharge operations during the driving of the PDP.

Between both ends of the scan driving IC 10, $V_{out_L}$ applies a waveform loaded with main data to a panel, and power recovered through a power recovery circuit of the panel is applied to $V_{out_H}$. In addition, $V_{out_H}$ sustains the same level as the electric potential of $V_{out_L}$ through internal diodes of the field-effect transistors inside the scan driving IC 10. Therefore, it is difficult to damage the scan driving IC 10 during the normal operation of the PDP.

When a scan voltage is applied to the PDP, because a voltage loaded in the scan driving IC 10 is applied as the stress of the IC, the scan voltage is determined by the rated voltage of the scan driving IC 10.

In a case where the PDP abnormally operates, or if switches (not shown) connected to the rear port of the scan driving IC 10 fail to operate properly, when the $V_{out_H}$ potential of the scan driving IC 10 is applied to be higher than the $V_{out_L}$ potential by a degree of no less than the rated voltage of the scan driving IC 10, the scan driving IC 10 is damaged. Actually, during experiments or running operations, the scan driving IC 10 is found to be often damaged.

When the rated voltage of the scan driving IC 10 is between about 100 and 150V, the maximum operation voltage of the PDP is between 400 and 500V, so the PDP normally operates and $V_{out_H}$ and $V_{out_L}$ sustain the same level.

However, when a switch arranged between $V_{out_L}$ and $V_{out_H}$ fails to operate properly in a state where a voltage of 450V is loaded in to $V_{out_L}$ and $V_{out_H}$, $V_{out_H}$ sustained to be at 450V. Because $V_{out_L}$ is connected to a ground, an electric potential difference between $V_{out_H}$ and $V_{out_L}$ is approximately 450V. Therefore, because the electric potential difference between both ends of the scan driving IC 10 is 450V, which is higher than the rated voltage of the scan driving IC 10 of between 100 and 150V, the scan driving IC is damaged.

Because the scan driving IC 10 is expensive and not easily repaired, this results in a cost-prohibitive repair.

SUMMARY OF THE INVENTION

It is an object of the present invention to provide a circuit for driving a PDP, which is capable of maximizing efficiency in expenses and repair by protecting a scan driving IC.

In one aspect of an embodiment of the present invention, there is provided an apparatus for driving a PDP including a plurality of address electrodes and a plurality of scan electrodes and sustain electrodes arranged in a zig-zag pattern so as to make pairs with each other, the apparatus comprising an address driving circuit for applying an address signal for selecting a discharge cell to the plurality of address electrodes and a sustain driving circuit and a scan driving circuit for alternately applying a sustain-discharge voltage to the scan electrodes and to the sustain electrodes, to thus sustain-discharge the selected discharge cell. The scan driving circuit comprises a protecting circuit for uniformly sustaining an electric potential difference between both ends of the scan driving circuit so that the electric potential difference between both ends of the scan driving circuit is no more than a rated voltage of the scan driving circuit.

The scan driving circuit comprises a plurality of scan driving IC serially comprising first and second transistors.

The protecting circuit comprises a voltage sensor, for sensing an electric potential difference between both ends of the scan driving circuit, and a switch turned on and off according to the result of the sensing of the voltage sensor, the switch being used for sustaining the potential difference between both ends of the scan driving circuit to be uniform. The voltage sensor is comprised of a serially connected resistor stream. The switch has a rated voltage of no less than the rated voltage of a device installed in the scan driving circuit. The protecting circuit is further comprised of a Zener diode for clamping the potential between both ends of the scan driving circuit to be no more than a predetermined voltage. The Zener diode is set to have a value of no more than the rated voltage of the scan driving circuit.

BRIEF DESCRIPTION OF THE DRAWINGS

The accompanying drawings, which are incorporated in and constitute a part of the specification, illustrate embodiments of the invention, and, together with the description, serve to explain the principles of the invention, in which.

DETAILED DESCRIPTION OF THE PREFERRED EMBODIMENTS

In the following detailed description, only two preferred embodiments of the invention are shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

An apparatus for driving a common PDP includes a controller, an address driving circuit, a scan driving circuit, and a sustain driving circuit.

The controller generates driving control signals according to a video signal from the outside. The address driving circuit processes an address signal among the driving control signals, generates a display data signal, and applies the display data signal to address electrode lines. The sustain driving circuit processes a sustain driving control signal among the driving control signals and applies the sustain driving control signal to sustain electrode lines. The scan driving circuit processes a scan driving control signal among the driving control signals and applies the scan driving control signal to scan electrode lines.

Figure 1:
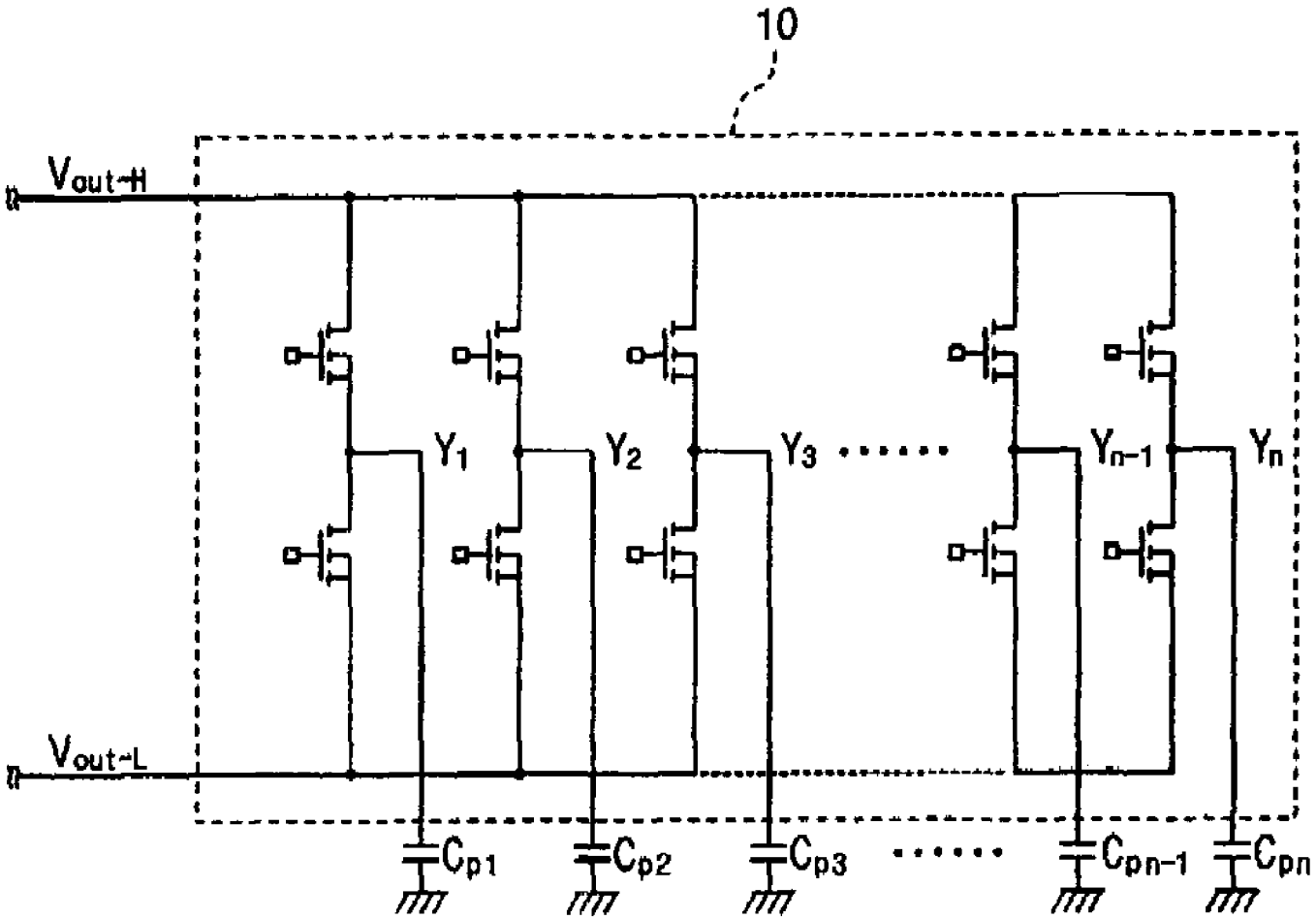
FIG. 1 is a block diagram showing a structure of a scan driving IC of a common PDP of the prior art, which shows the arrangement of an electrode of the common PDP.
Figure 2:
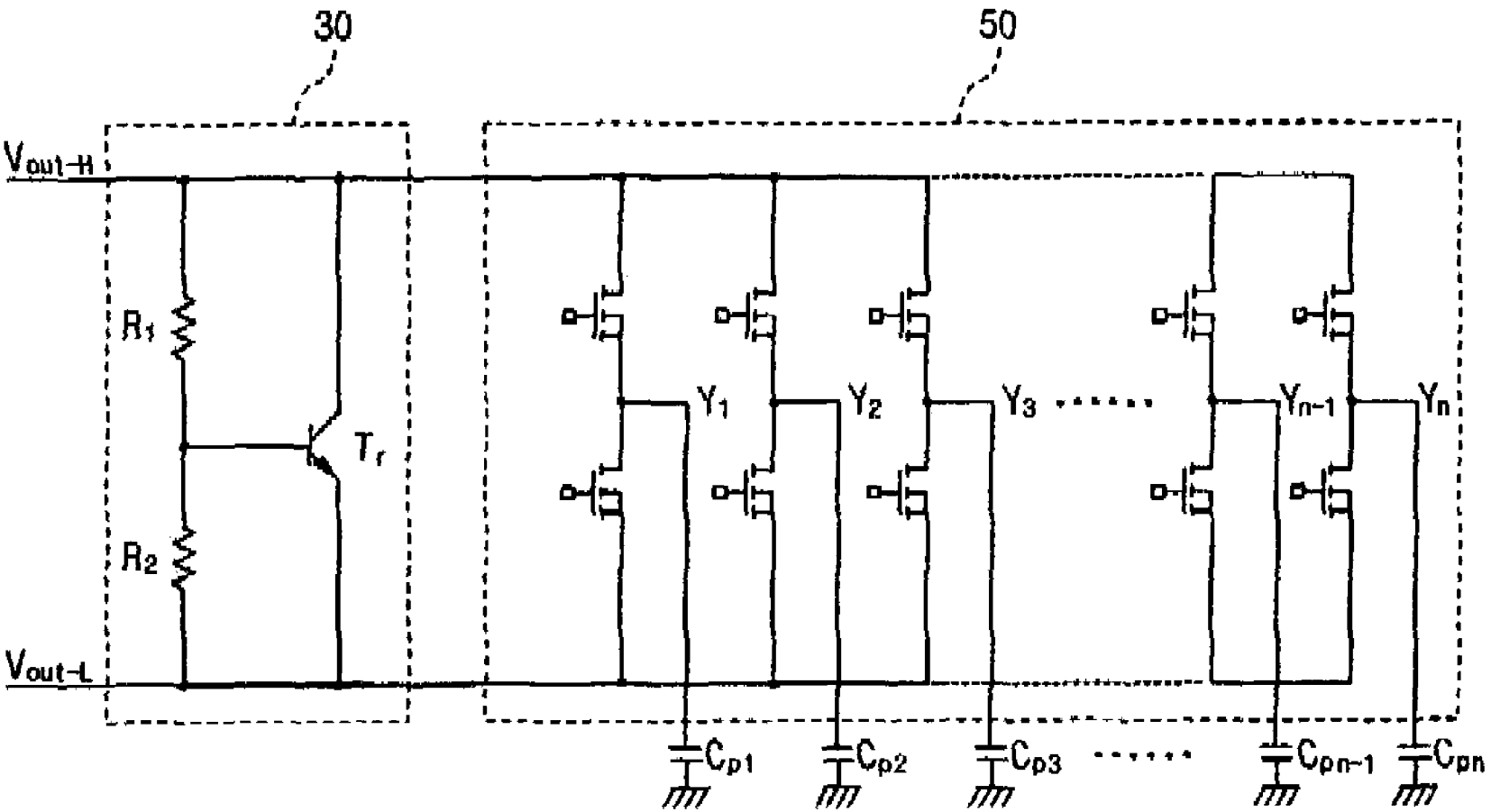
FIG. 2 shows a structure of a circuit for driving a PDP according to a first embodiment of the present invention.

FIG. 2 shows a structure of a circuit for driving a PDP according to a first embodiment of the present invention.

As shown in FIG. 2, a scan driving circuit 50 according to a first embodiment of the present invention includes a plurality of scan data ICs, and the scan data IC has two field-effect transistors and an output positioned between the two field-effect transistors. Therefore, the scan driving circuit 50 is an IC formed of multiple outputs $Y_1$, $Y_2$, $Y_3$, . . . $Y_{n-1}$, and $Y_n$. A protecting circuit 30 is connected to the rear port of the scan driving circuit 50. Panel capacitances $C_{p1}$, $C_{p2}$, $C_{p3}$, . . . $C_{pn-1}$, and $C_{pn}$ are respectively connected to the multiple outputs.

Because one output is arranged in each line of the PDP in the scan driving circuit 50, when the PDP includes 480 lines, for example, the variable 'n' of the multiple outputs becomes 480.

In particular, the protecting circuit 30 includes first and second resistors R1 and R2 and a transistor Tr so that an electric potential difference between both ends of the scan driving circuit 50 is no more than the rated voltage of the IC.

The first and second resistors R1 and R2 are for sensing the electric potential difference between $V_{out_H}$ and $V_{out_L}$. The resistance values are set within a range where the transistor $T_r$ is turned on when the electric potential difference between both ends of the scan driving circuit 50 is sensed to be no less than the rated voltage of the scan driving circuit 50. Also, the rated voltage of the transistor Tr is no less than the rated voltage of the field effect transistor of the scan driving circuit 50.

According to the operation of the protecting circuit 30, when $V_{out_H}$ is higher than the potential of $V_{out_L}$ by a degree of no less than the rated voltage of the scan driving circuit 50, the electric potential difference between $V_{out_H}$ and $V_{out_L}$ is sensed by the first and second resistors R1 and R2.

Because a voltage between $V_{out_H}$ and $V_{out_L}$ is divided by the first and second resistors R1 and R2 and is applied to the base port of the transistor $T_r$, the transistor $T_r$ is turned on. Accordingly, when the transistor $T_r$ is turned on, because $V_{out_H}$ and $V_{out_L}$ have the same level of voltage, it is possible to prevent the scan driving circuit 50 from being damaged The transistor $T_r$ of the protecting circuit 30 is a device that is separate from the scan driving circuit 50. Even though the transistor is damaged, the operation of the scan driving circuit 50 is hardly affected. Because the transistor $T_r$ is cheaper than the internal device of the scan driving circuit 50, the transistor $T_r$ can be easily exchanged. This results in an improved efficiency over the prior art.

Figure 3:
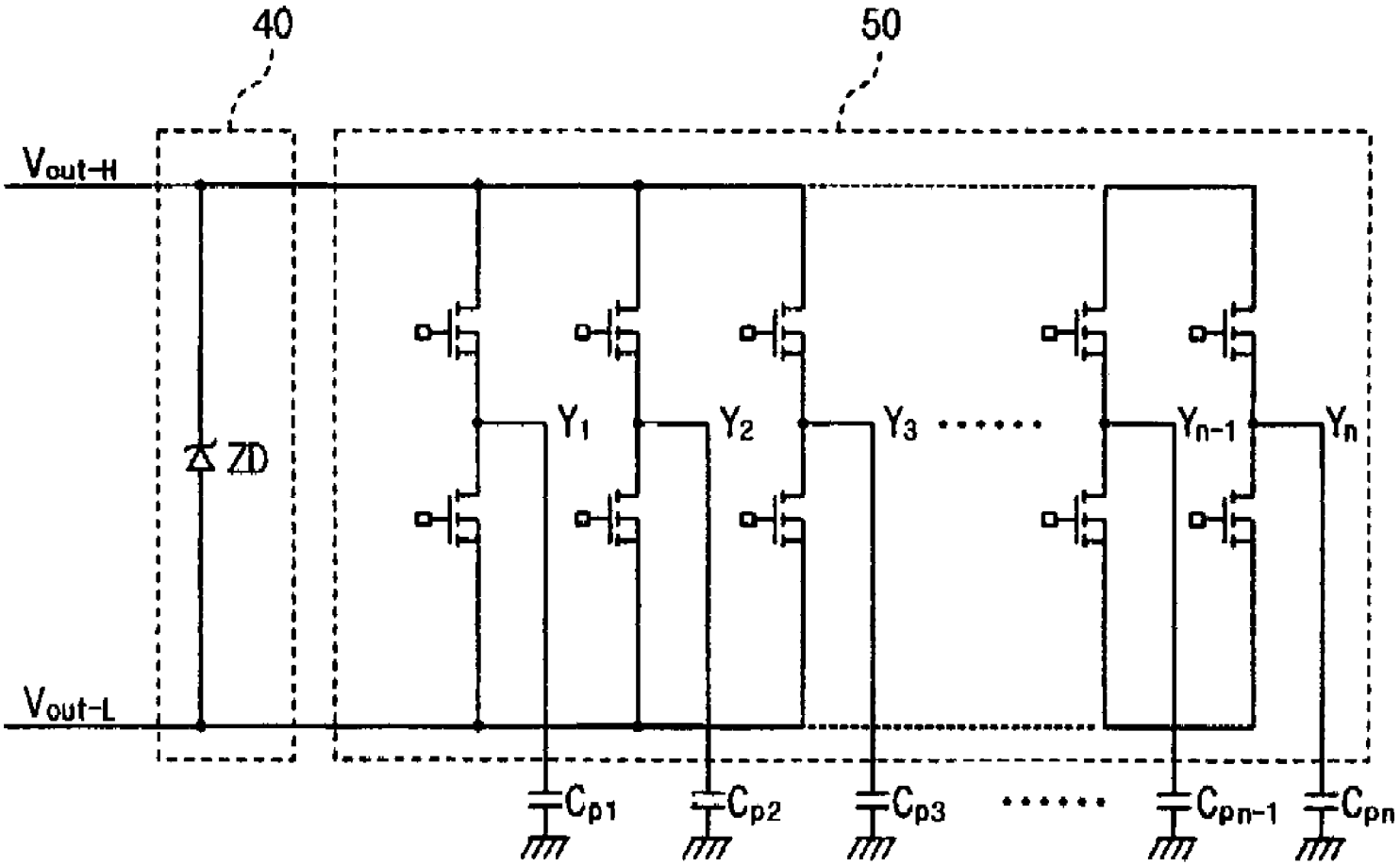
FIG. 3 shows a structure of a circuit for driving a PDP according to a second embodiment of the present invention.

FIG. 3 shows a structure of a circuit for driving a PDP according to a second embodiment of the present invention.

As shown in FIG. 3, the scan driving circuit 50 according to the second embodiment of the present invention has the same structure as shown in FIG. 2. The only difference lies in the structure of the protecting circuit 40. That is, the protecting circuit 40 according to the second embodiment of the present invention is formed of a is Zener diode (ZD).

The ZD uniformly restricts a voltage between both ends of the scan driving circuit 50. The value of the ZD is set to be no more than the rated voltage of the scan driving circuit 50.

When the potential of $V_{out_H}$ becomes higher than the potential of $V_{out_L}$ to a degree of no less than the rated voltage of the scan driving circuit 50, because the ZD sustains the potential suitable for the previously set ZD value, it is possible to prevent the scan driving circuit 50 from being damaged.

For example, in a case where the value of the ZD is set as 100V, when $V_{out_H}$ is 90V and $V_{out_L}$ is 0V, the ZD does not conduct electricity. Accordingly, current does not flow through the IC. When $V_{out_H}$ is 110V and $V_{out_L}$ is 0V, for example, the ZD conducts. Accordingly, a current of 10V flows.

The ZD is arranged outside of the scan driving circuit 50 in FIG. 3.

While this invention has been particularly shown and described with reference to preferred embodiments thereof, it will be understood by those skilled in the art that various changes in form and details may be made therein without-departing from the spirit and scope of the invention as defined by the appended claims.

As mentioned above, according to the circuit for driving the AC PDP according to the present invention, it is possible to prevent the scan driving circuit from being damaged by adding a protecting circuit that includes an on-off switch for uniformly sustaining the electric potential difference between both ends of the scan driving circuit to be no more than the rated voltage of the scan driving circuit outside or inside the scan driving circuit. Accordingly, it is possible to maximize efficiency in expenses and repair as compared to the prior art.

What is claimed is:

1. An apparatus for driving a plasma display panel comprising an address electrode and a scan electrode and sustain electrode pair with a display cell defined by a cross-section there between, comprising:

an address driving circuit that applies an address signal voltage to the address electrode to select the display cell; and a sustain driving circuit and a scan driving circuit that apply a sustain signal voltage to the sustain electrode and the scan electrode, respectively, to cause a sustain-discharge in the selected display cell, wherein the scan driving circuit comprises a protecting circuit that substantially uniformly sustains an electric potential difference between both ends of the scan driving circuit so that the electric potential difference between both ends of the scan driving circuit cannot exceed a predetermined voltage, wherein the protecting circuit comprises:

a voltage sensor that senses the electric potential difference between both ends of the scan driving circuit; and a switch that is turned on and off according to a result of the sensing of the voltage sensor.

2. The apparatus of claim 1, wherein the predetermined voltage is a rated voltage of the scan driving circuit.

3. The apparatus of claim 1, wherein the voltage sensor comprises a serially connected resistor stream.

4. The apparatus of claim 2, wherein the switch has a rated voltage of no less than a rated voltage of a device installed in the scan driving circuit.

5. The apparatus of claim 4, wherein the device installed in the scan driving circuit comprises at least one field-effect transistor.

6. A plasma display panel, comprising:

a display electrode;

a driving integrated circuit comprising a first transistor and a second transistor, the first transistor having a first terminal coupled to the display electrode, the second transistor having a first terminal coupled to the display electrode;

a voltage sensor sensing a first voltage level corresponding to an electric potential difference between a second terminal of the first transistor and a second terminal of the second transistor; and a switch being turned on and off according to a result of the sensing of the voltage sensor.

7. The plasma display panel of claim 6, wherein the switch is turned on and off so that the first voltage level cannot exceed a predetermined voltage.

8. The plasma display panel of claim 7, wherein the predetermined voltage is a rated voltage of the driving integrated circuit.

9. The plasma display panel of claim 8, wherein the switch has a rated voltage of no less than any one of rated voltages of the first transistor and the second transistor.

10. The plasma display panel of claim 9, wherein the first transistor and the second transistor are field-effect transistors.

11. The plasma display panel of claim 10, wherein the first transistor and the second transistor are n-type field-effect transistors, the first terminal of the first transistor is a source and the second terminal of the first transistor is a drain, and the first terminal of the second transistor is a drain and the second terminal of the second transistor is a source.

12. The plasma display panel of claim 7, wherein the voltage sensor includes a plurality of resistors coupled in series with each other.

13. The plasma display panel of claim 12, wherein the switch is a bipolar transistor and the plurality of resistors includes a first resistor and a second resistor, the first resistor being coupled between a collector of the bipolar transistor and a base of the bipolar transistor, and the second resistor being coupled between the base of the bipolar transistor and an emitter of the bipolar transistor.

* * * * *